US007634920B2

(12) United States Patent
Koenig

(10) Patent No.: US 7,634,920 B2
(45) Date of Patent: Dec. 22, 2009

(54) KNITTED FABRIC, METHOD AND DEVICE FOR PRODUCING SAID FABRIC

(76) Inventor: Reinhard Koenig, Albstrasse 2, D-76275 Ettlingen (DE)

( * ) Notice: Subject to any disclaimer, the term of this patent is extended or adjusted under 35 U.S.C. 154(b) by 424 days.

(21) Appl. No.: 10/547,841

(22) PCT Filed: Mar. 8, 2004

(86) PCT No.: PCT/DE2004/000463

§ 371 (c)(1),
(2), (4) Date: May 18, 2006

(87) PCT Pub. No.: WO2004/079068

PCT Pub. Date: Sep. 16, 2004

(65) Prior Publication Data

US 2006/0272357 A1 Dec. 7, 2006

(30) Foreign Application Priority Data

Mar. 6, 2003 (DE) ..... 103 09 844

(51) Int. Cl.
*D04B 9/14* (2006.01)

(52) U.S. Cl. ..... 66/9 B; 66/168

(58) Field of Classification Search ..... 66/9 B, 66/8, 9 R, 191, 198, 186
See application file for complete search history.

(56) References Cited

U.S. PATENT DOCUMENTS 3,226,952 A * 1/1966 Cassady ..... 66/9 B
3,728,872 A * 4/1973 Thore ..... 66/9 B
3,877,254 A 4/1975 Walford
4,006,609 A * 2/1977 Abler ..... 66/9 B
4,245,487 A * 1/1981 Schaab et al. ..... 66/9 B
4,563,884 A * 1/1986 Kunde et al. ..... 66/9 B
5,134,863 A * 8/1992 Hanna ..... 66/9 B
5,431,029 A * 7/1995 Kuhrau et al. ..... 66/9 B
5,809,804 A * 9/1998 Kuhrau et al. ..... 66/9 B
6,125,662 A 10/2000 Bizer et al.
6,151,920 A * 11/2000 Schindler et al. ..... 66/9 R
6,247,335 B1 * 6/2001 Schaeberle et al. ..... 66/9 B
6,766,668 B2 * 7/2004 Sinykin ..... 66/191

FOREIGN PATENT DOCUMENTS

DE 28 04 068 8/1978
DE 30 21 303 A1 12/1981
DE 197 07 053 A1 8/1998
GB 1 538 924 1/1979
GB 1 584 324 2/1981
GB 2 077 306 A 12/1981

* cited by examiner

*Primary Examiner*—Danny Worrell
(74) *Attorney, Agent, or Firm*—Michael J. Striker

(57) ABSTRACT

A knitted fabric and also a method and a device for the production thereof are described. The knitted fabric is formed according to the invention from a yarn material (4) which contains a continuous fiber web (5) in which staple fibers are disposed untwisted and essentially parallel to each other. The method and the device relate to measures according to the invention for supplying and processing the yarn material (4).

28 Claims, 7 Drawing Sheets

KNITTED FABRIC, METHOD AND DEVICE FOR PRODUCING SAID FABRIC

Figure 1:
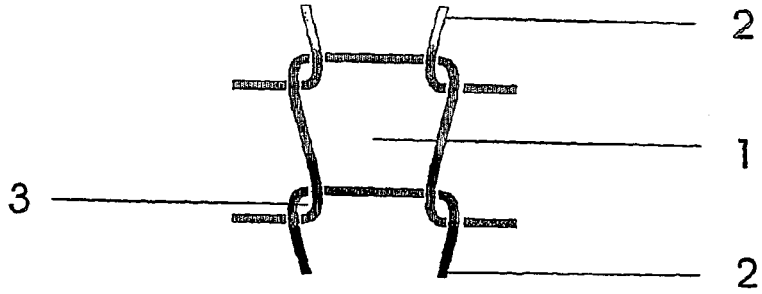

The invention relates to a knitted fabric of the type indicated in the preamble of claim 1 and also to a method and a device for production thereof corresponding to the preambles of claims 6 and 16.

All known knitted fabrics of the mentioned type have in common that they have or require at least one basic knitted fabric produced from yarn material. The character of a knitted fabric is shaped essentially by the type of yarn material which is used and the type of weave within the basic knitted fabric which is provided in the individual case. For knitted fabrics of the clothing sector, particular requirements apply in addition with respect to wearing properties, such as for example water absorption capacity, softness or flexibility. Included in the term yarn material here are all yarn-shaped materials which comprise one or more, long stretched-out or endless yarns.

The wearing comfort of a knitted item of clothing increases with its softness. In the case of knitted fabrics of all types produced to date, said knitted fabrics being produced with yarn materials comprising yarns and containing predominantly naturally staple fibres or mixtures thereof with chemical fibres, the softness of the knitted fabrics depends extensively upon the yarn structure and upon the spinning methods which are used for production thereof. The purpose of the spinning methods resides in arranging the staple fibres by imparting a twist with each other such that a yarn is consequently produced, the essential feature of which resides in the accommodation of tensile forces.

Extremely soft knitted fabrics can be produced neither from standard ring spun yarns nor from so-called unconventional yarns, such as for example rotor yarns, bundle yarns or wound yarns since yarns always have twists and bundles which lead to a significant rigidity in the knitted fabric. At best, classic ring spun yarn provides a stitch structure with pleasant wearing properties. The desire for extremely soft knitted fabrics can therefore not be fulfilled with the known types of yarn. This also applies when, in order to achieve particular properties, in addition lining or plush yarns (DE 28 04 068 A1, DE 197 07 053 A1) are integrated in a basic knitted fabric or the yarns or knitted fabrics are finished in a particular manner.

In particular, so-called high pile or synthetic fur fabrics are known as knitted fabrics with extremely soft surfaces (DE 30 21 303 A1). In the production of these fabrics, fibres presented by a carding unit are combed into the knitting needles by means of a special combing cylinder. In the case of knitted fabrics of this type, the fibres do not form a continuous yarn but merely fibre flocks which protrude from the wrong side of the fabric. The production of basic knitted fabrics, such as single face fabrics alone is not possible with fibre flocks of this type.

It has already been attempted also to produce loosely twisted yarns during spinning by means of special measures. Limits are however set by spinning technology with respect to the softness of a yarn because with reducing twists in the yarn the tensile strength is lost.

The relatively high costs of fine yarns are a further annoyance. These increase superproportionally with the fineness so that cost limits are set in this direction to production of a soft, stretchable knitted yarn. In addition, the yarns which are used are presented to the knitting machines in the form of spools which are produced in processes separate from the knitting temporally and spatially, which likewise effects the production costs.

Starting from this state of the art, the object underlying the invention is to shorten the production process and to produce knitted fabrics on a staple fibre basis which improve the wearing comfort and which are extremely soft to the touch-even without plush or lining yarns, without integrating additional fibre flocks and without special finishing or the like. In addition, the object of the invention resides in proposing methods and devices for producing such knitted fabrics.

In order to achieve this object, the yarn material in the case of the initially described knitted fabric is characterised in that it contains a continuous fibre web in which the staple fibres are disposed virtually untwisted and essentially parallel to each other. The method according to the invention and the device according to the invention are characterised by the features of claims 6 and 16.

A particular feature of the knitted fabric according to the invention resides in the fact that it comprises a yarn material which does not represent a yarn. Rather the yarn material according to the invention contains a fibre web which is formed from untwisted and essentially parallel staple fibres. As a result, a knitted fabric with extreme softness is obtained.

In a preferred embodiment of the invention, a loop-forming yarn for the knitted fabric according to the invention is produced from two components, namely the fibre web according to the invention and an auxiliary yarn which runs preferably parallel and untwisted relative to the latter. The auxiliary yarn can be a monofilament or multifilament, the multifilament being able to be provided also with typical protective twists. Independently thereof, the auxiliary yarn is chosen expediently in such a manner that the character of the knitted fabric is shaped above all by the component comprising the fibre web.

The method according to the invention and the device according to the invention start preferably, before the loop formation, by stretching a fibre web which is configured in the manner of a roving in drawing equipment to the desired fineness and by processing it into loops thereafter, directly or after a pretreatment which is expedient for reasons of knitting technology. The latter can be effected for example with a flat or circular knitting machine which can be configured as a right/right, right/left or left/left circular knitting machine. Starting therefrom, various variants according to the invention are proposed.

If the knitting machine is configured as a micro-circular knitting machine which is suitable for example for producing tubular fabric for web material, the fibre web is supplied expediently to a knitting point situated in the immediate vicinity after leaving the drawing equipment and is processed immediately in the latter into loops.

A second variant according to the invention is present if the staple fibres exiting from the drawing equipment pass as a fibre web into a spinning device in which they are spun into an unconventional yarn (e.g. bundle yarn or wound yarn). As a result, the fibre web is compacted in order to be able to transport it over larger distances to the knitting point of a circular knitting machine. However the achievement of maximum tensile strength is not hereby of importance but instead the maintenance of the desired soft feel.

The same is true for a third variant in which the fibre flow exiting from the drawing equipment is spun by a twisting element into a temporary, typically twisted classic yarn which is rotated in a spinning pipe and transported through the latter to a knitting point or to a yarn guide assigned to the knitting point. A soft feel is produced because the typical twists on the short stretch between the yarn guide or the end of the spinning pipe and the knitting point are loosened again by the false twist effect. The obtained knitted fabric is then extremely soft and pleasant to the touch.

Finally, a further variant provides that in addition to the fibre web an auxiliary yarn runs in also at the knitting point. The auxiliary yarn is preferably supplied before the pair of delivery rollers of the drawing equipment. Said auxiliary yarn passes through the pair of delivery rollers and takes part in the formation process of the temporary yarn. The combined yarn material comprising the fibre flow and the auxiliary yarn forms loops which in turn have an extremely soft feel, in particular because no twists exist between auxiliary yarn and fibre flow, i.e. fibre web and auxiliary yarn run in parallel in the loops.

Further advantageous features of the invention are revealed in the dependent claims.

Figure 2:
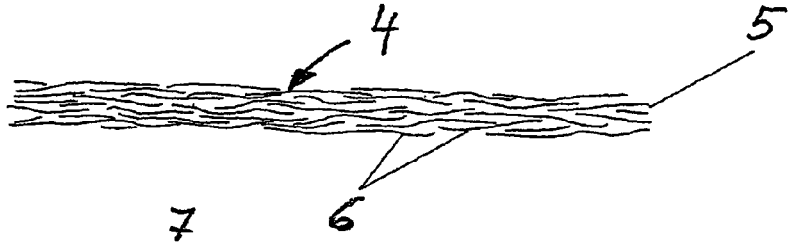
Figure 3:
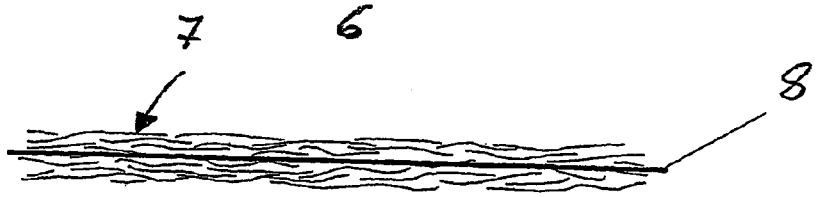
Figure 4:
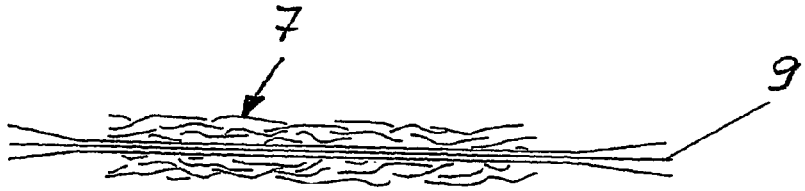
Figure 5:
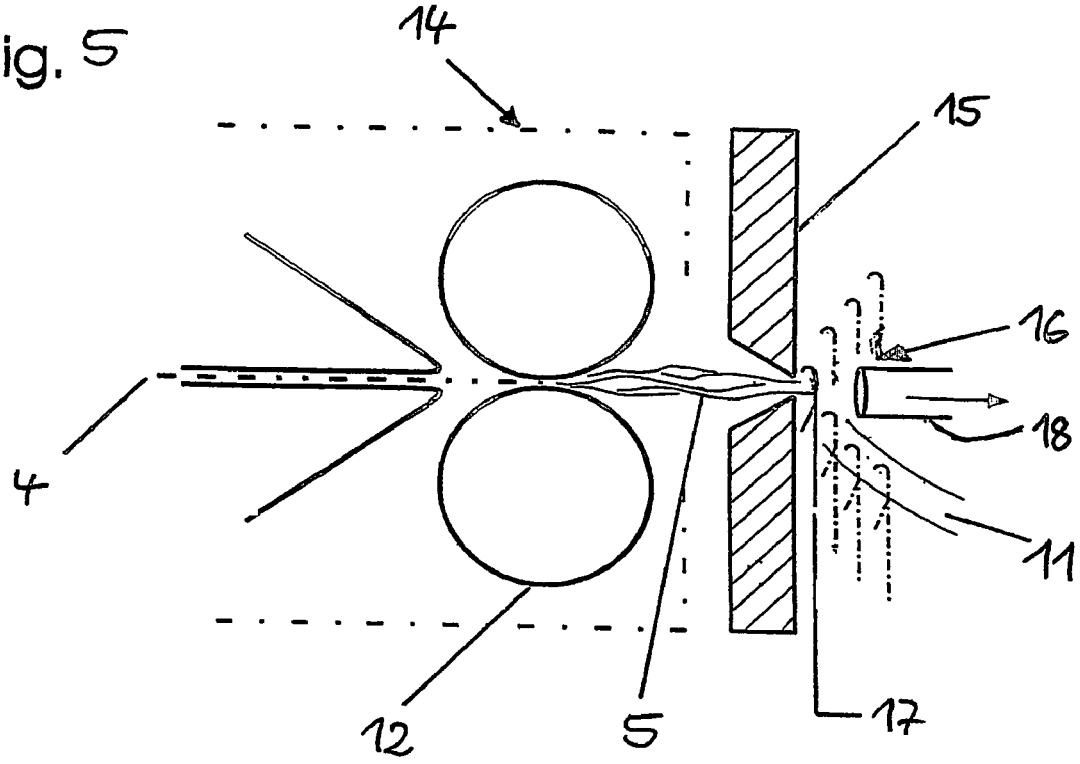
Figure 6:
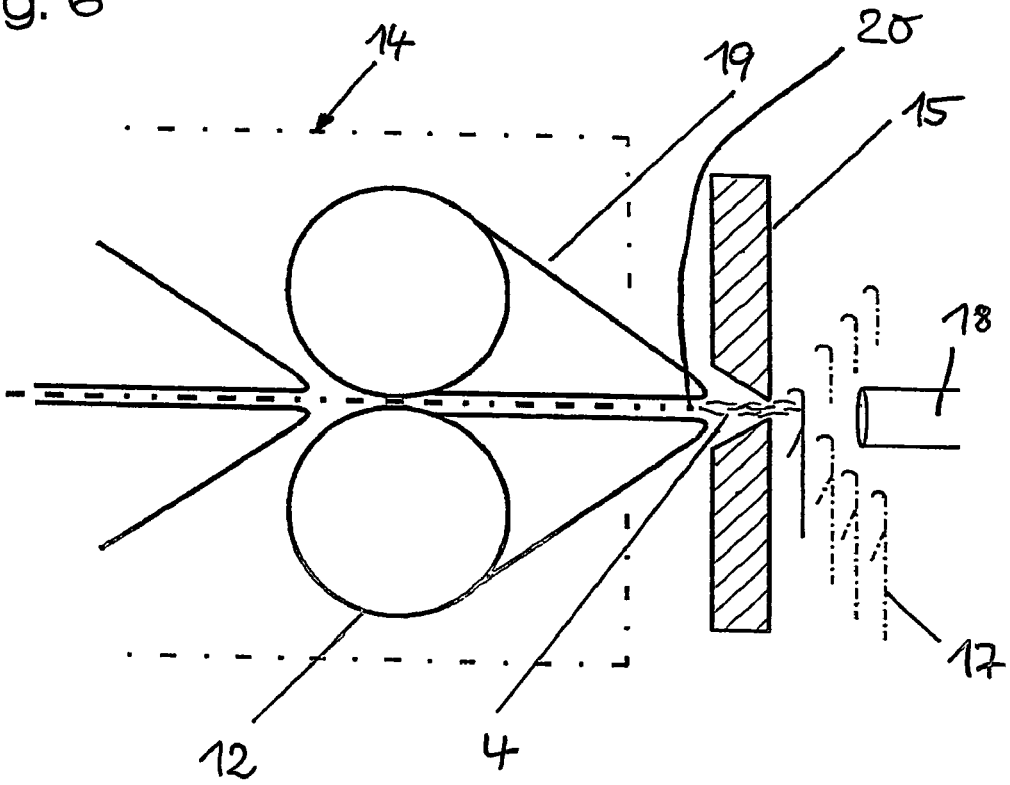
Figure 7:
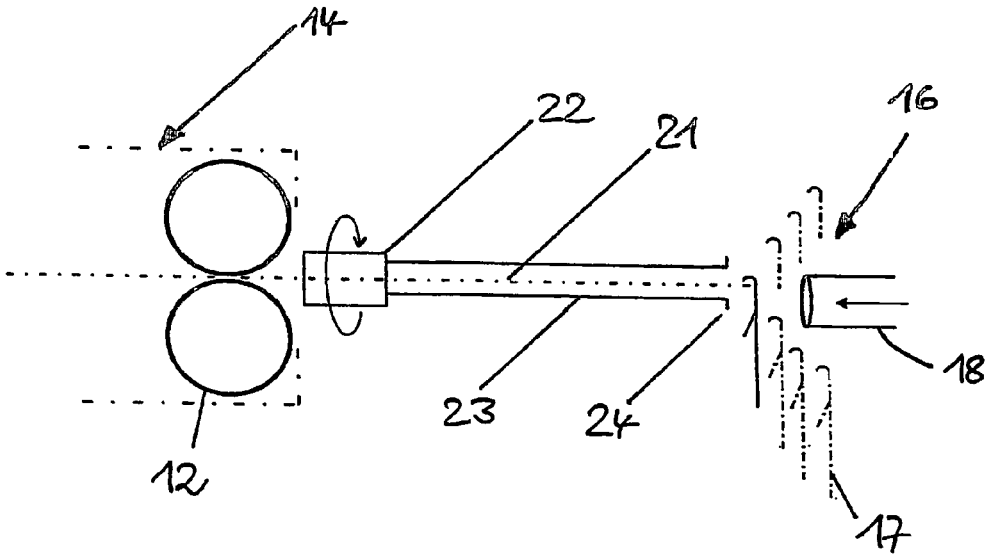
Figure 8:
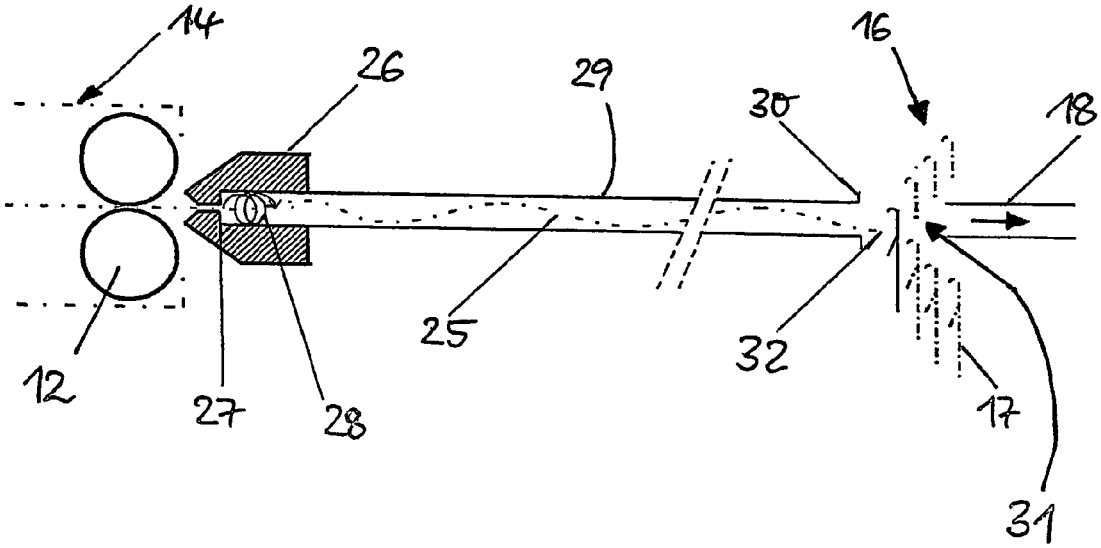
Figure 9:
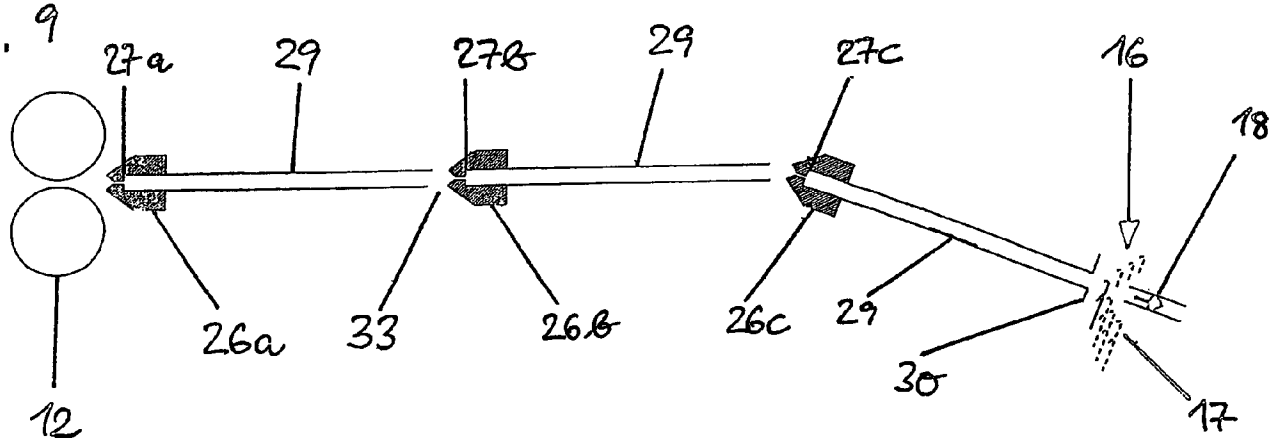
Figure 10:
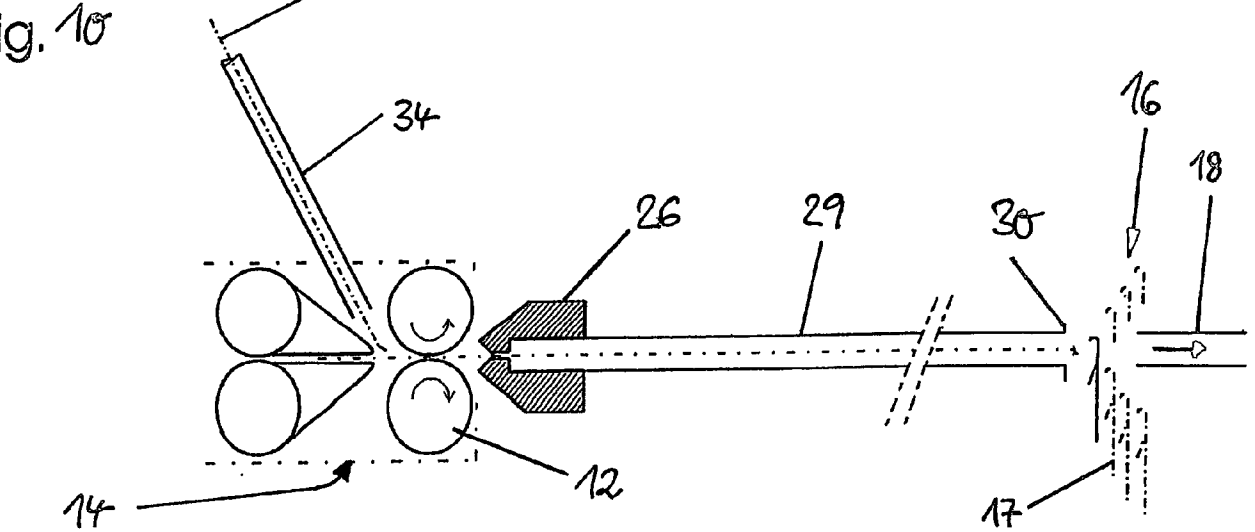
Figure 11:
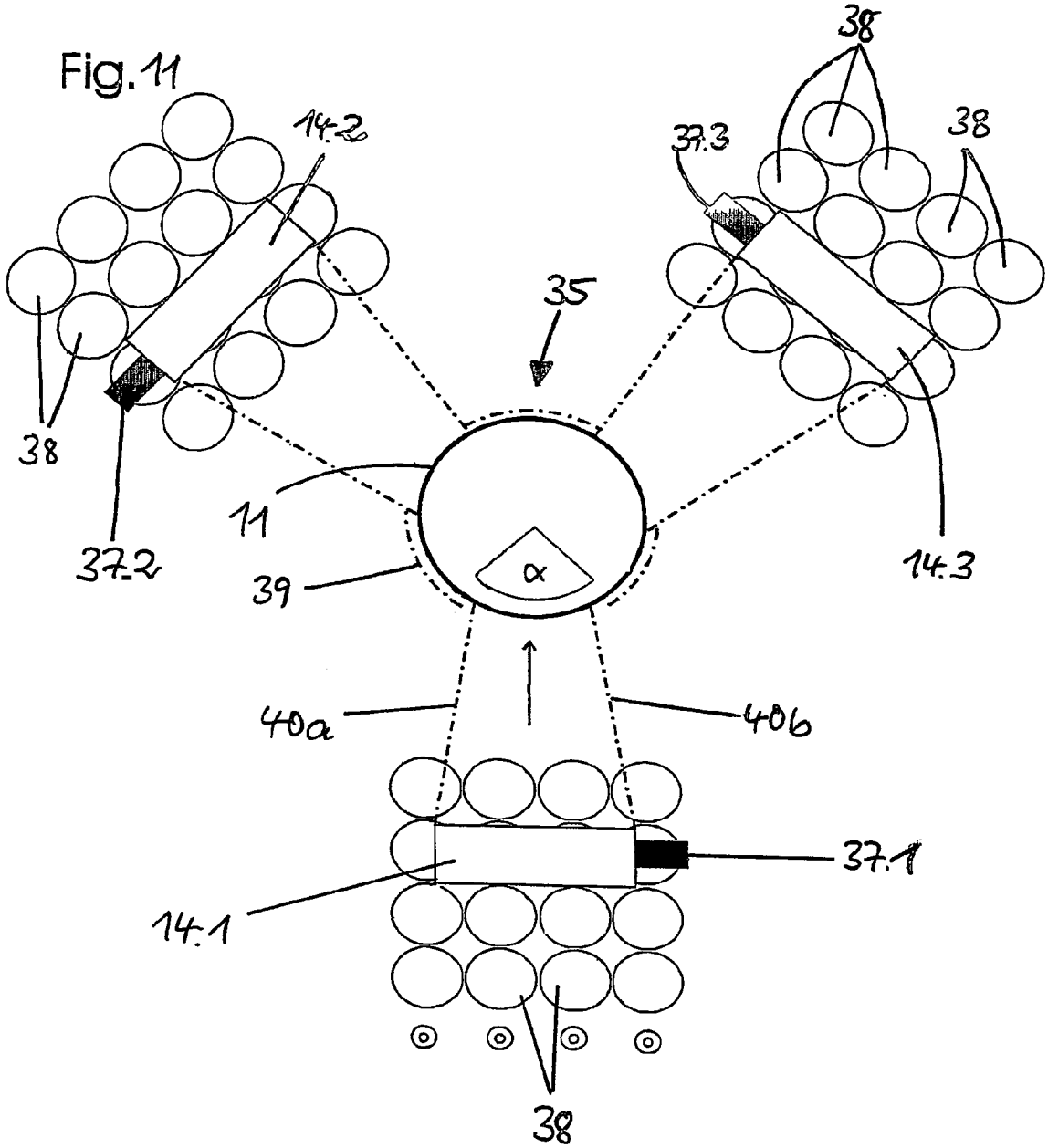
Figure 12:
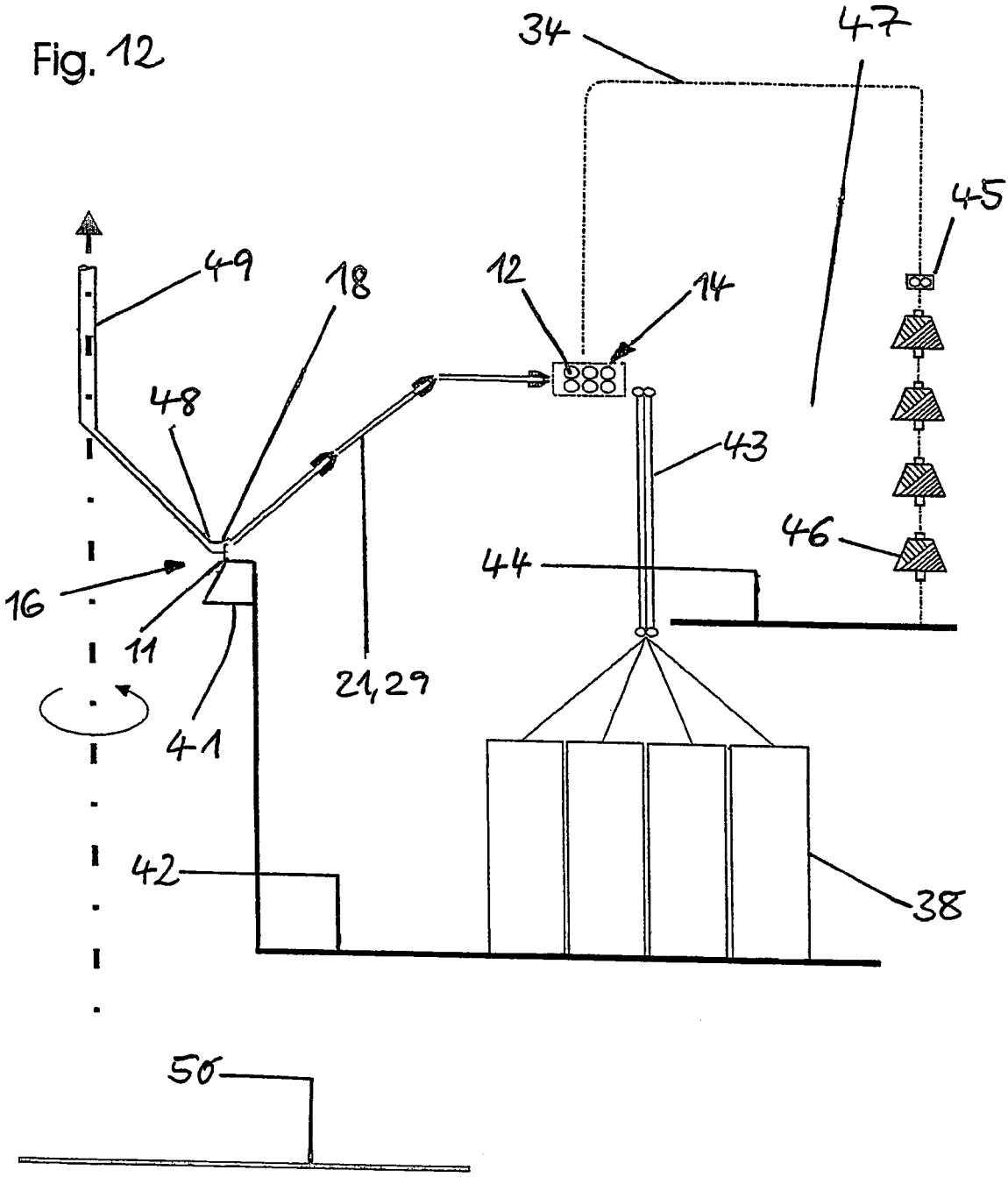
Figure 13:
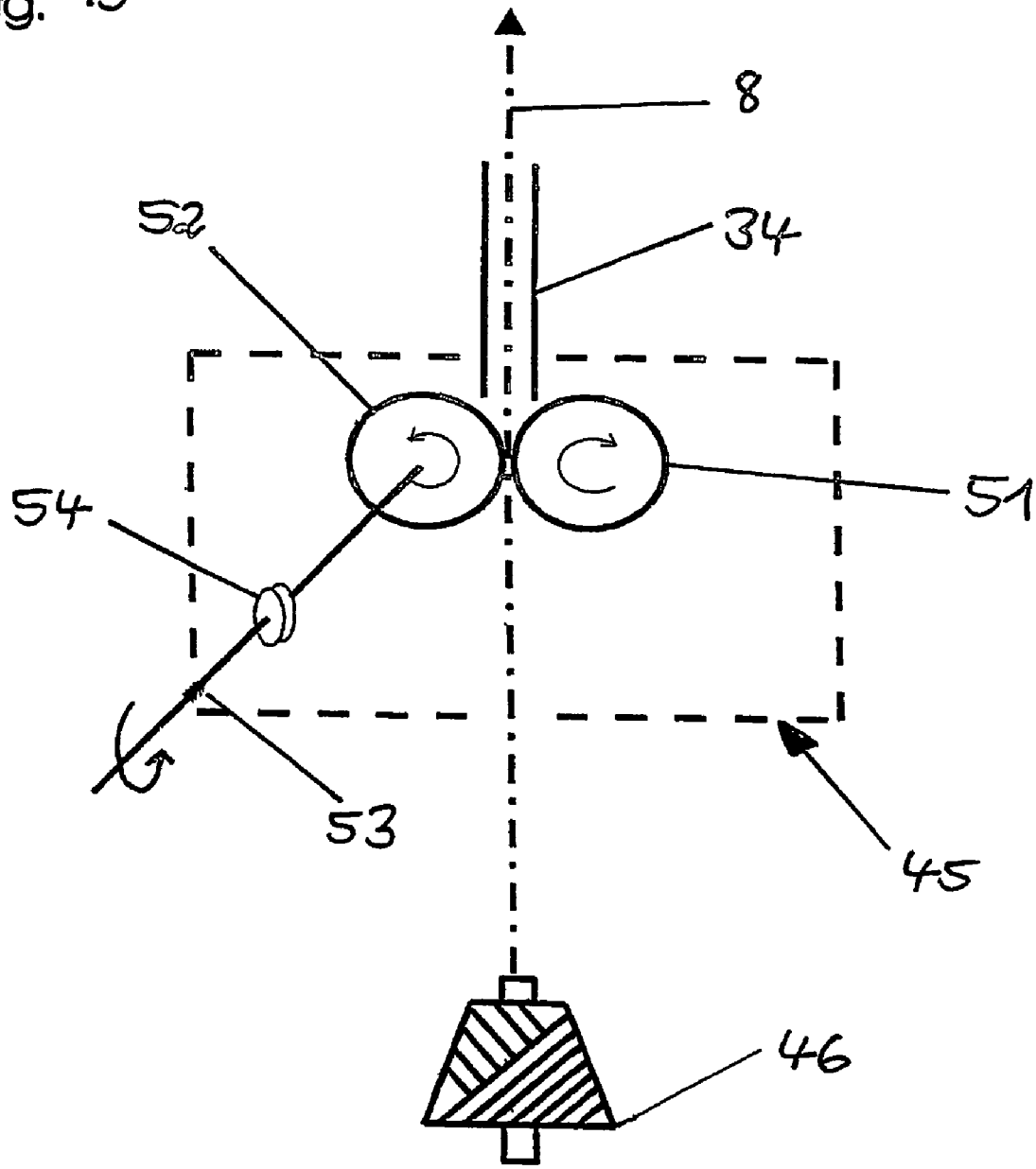

The invention is explained subsequently in more detail with reference to embodiments. There are shown:

FIG. 1 a loop of a knitted fabric in plan view;

FIG. 2 a yarn material according to the invention comprising a fibre web;

FIG. 3 a yarn material according to the invention comprising a fibre web and an auxiliary yarn (monofilament);

FIG. 4 a yarn material analogous to FIG. 3 in which the auxiliary yarn comprises however a multifilament;

FIG. 5 a schematic section through the knitting point of a circular knitting machine in an embodiment for processing long staple fibres;

FIG. 6 a section corresponding to FIG. 1 through the knitting point of a circular knitting machine in an embodiment for processing short staple fibres;

FIG. 7 a schematic section through the knitting point of a circular knitting machine in an embodiment with spinning elements of the known type;

FIG. 8 a schematic section through the knitting point of a circular knitting machine in an embodiment with a twisting element for producing a temporary yarn;

FIG. 9 a schematic section through the knitting point of a circular knitting machine in an embodiment with a plurality of twisting elements disposed in succession;

FIG. 10 a schematic section through the knitting point of a circular knitting machine in an embodiment with a conveying pipe for an auxiliary yarn;

FIG. 11 the basic outline of a circular knitting machine according to the invention;

FIG. 12 a vertical partial section through the circular knitting machine according to FIG. 11; and FIG. 13 a purveyor for auxiliary yarns in the circular knitting machine according to FIG. 12.

In FIG. 1, a loop 1 of a knitted fabric of the known type is illustrated. It comprises a yarn material 2 and has the normal, e.g. for a single face knitted fabric, typical crossing points 3.

In FIG. 2, a yarn material 4 according to the invention which is suitable for producing the knitted fabric according to FIG. 1 is illustrated. It comprises a yarn in the form of a fibre web 5 which is produced continuously or endlessly like a normal yarn, said fibre web being formed by staple fibres 6 which lie untwisted and extensively parallel to the longitudinal extension of the yarn material 4.

The fibre web 5 according to FIG. 2 has per se no strength. However, it was shown surprisingly that, due to the crossing points 3 within a loop 1, the fibre web 5 obtains sufficient strength, in particular tensile strength, and consequently is well suited for producing knitted fabrics, such as e.g. knitted items of clothing.

If an external force acts on a knitted fabric produced with the fibre web 5, then the staple fibres get jammed in the crossing points 3 and accommodate force via the frictional connection. The loops 1 and the knitted fabric formed from them are then just as strong in the case of a knitted fabric comprising a yarn. One important difference for the invention resides in the softness to the touch. The feel of a knitted fabric which comprises yarn material 4 which is formed for its part from a fibre web 5 is incomparably soft.

A similar, if not quite so soft feel is achieved when a yarn material 7 is used which comprises a combination of the fibre web 5 and an endless auxiliary yarn 8 (FIG. 3). The character of the yarn material 7 is shaped expediently here also by the staple fibre web 5. This applies in particular when, in the material ratio fibre web 5/auxiliary yarn 8, the fibre web 5 dominates. Particularly good properties are achieved with a material distribution of for example 70% fibre web 5/30% auxiliary yarn 8.

The auxiliary yarn 8 can comprise for example a monofilament 8 (FIG. 3) or a multifilament 9 (FIG. 4). Combinations of the fibre web according to the invention with an auxiliary yarn 8 in the form of a yarn comprising staple fibres, e.g. a ring spun yarn, rotor yarn, bundle yarn or wound yarn etc. are also conceivable, however the material ratio fibre web 5/auxiliary yarn 8 should in this case preferably be sufficiently large in order that the desired soft feel of the knitted fabric according to the invention is not impaired by the auxiliary yarn 8 or 9. Because all knitted fabrics 1 with a fibre web 5 as described above should according to the invention be distinguished by a particularly soft feel which differs significantly from the feel of known knitted fabrics produced from yarns.

The restoring moment in the knitted fabric, when applying the fibre web 5, is zero, or in combinations of fibre web 5/auxiliary yarn 9 virtually zero. The loop legs of the loop 1 appear therefore not to be lopsided but completely symmetrical.

The mode of production for the fibre web 5 according to the invention can in principle be chosen freely. A possible type of production resides for example in the cross sections of fibre bands (rovings) which come from drawing equipment or the like being reduced by application of further drawing equipment to a value suitable for knitting. There is thereby understood by a "roving", coarse, untwisted fibre band stored in cans or the like. Alternatively, the fibre webs 5 can be produced also from card slivers and be brought to the desired end fineness by drawing equipment.

It is important for the purposes of the invention that the fibre web 5 according to FIG. 2, in contrast for example to high-pile fabrics, forms a continuous (endless) yarn which is used for loop formation and for example can serve to produce a normal basic knitted fabric in the form of a smooth single face knitted fabric. Also the application of other weave patterns is possible, as with the application of yarns. Both long staple fibres (e.g. wool) and also short staple fibres, (e.g. cotton) and also fibres from materials other than textile materials, e.g. metal or plastic material fibres, can thereby be used.

Devices according to the invention can serve for producing a knitted fabric with the described yarn material 4 or 7, which are explained in more detail subsequently with reference to FIG. 5 to 13 and can be described for example as spin/knitting devices.

FIG. 5 shows the invention in the example of a circular knitting machine with a needle cylinder 11 of a very small diameter (e.g. 1"). Such a circular knitting machine is suitable in particular for processing long staple fibres and for producing knitted fabrics which can be used for example as web material. According to FIG. 5, a fibre web according to FIG. 2 serves as yarn material 4, said fibre web being supplied continuously from normal delivery rollers 12 of drawing equipment, indicated schematically with the reference number 14, to a yarn guide 15. The yarn material 4 comprises fibres 6 which are untwisted and disposed in an essentially parallel manner corresponding to FIG. 2 and, after its production in the drawing equipment 14, is processed immediately into loops, i.e. without an interposed spool process. The yarn guide 15 supplies the yarn material 4 to a schematically indicated knitting point 16 at which it is picked up by extended knitting needles 17, e.g. normal latch needles which are mounted displaceably in grooves of the needle cylinder 11, and processed analogously to FIG. 1 into loops.

A suction element 18 is disposed at the side of the yarn guide 15 orientated away from the delivery rollers 12 and on the rear side of the needles 17. The fibre web 5 exiting from the drawing equipment 14 is suctioned by the suction element 18 through the yarn guide 15 towards the needle cylinder 11 and is immediately processed into loops. The spacing of the yarn guide 15 from the needles 17 is only a few millimeters. The loop formation is consequently made possible in that the yarn material 4 is suctioned firstly by the suction element 18 and placed radially relative to the axis of the needle cylinder and is retained tensioned such that it can be caught by the knitting needles 17 which are raised into a yarn receiving position at the knitting point 16 and, when they are drawn off in the loop-forming position, can be processed into loops.

In this way, a knitted fabric is produced which is constructed from meshed yarn material 4. The yarn material 4 however does not represent a yarn although it entirely comprises staple fibres. A knitted fabric of this type is soft and in addition cheap to produce because the actual spinning process is dispensed with.

FIG. 6 shows a section through the knitting point of a circular knitting machine corresponding to FIG. 5 but for processing short staple fibres. The construction is therefore similar to that according to FIG. 5 but the delivery rollers 12 carry delivery belts 19. As a result, the spacing from a clamping point 20 for the fibre web 4, which point is the last in the direction of the circular knitting machine and formed by the delivery belts 19, up to the yarn guide 15 or to a loop-forming point can be very small and in particular equal to or smaller than the staple length of the fibres 6, as is required for proper loop formation. The device knits a very soft and in addition cheap knitted fabric because the actual spinning process is dispensed with.

Whilst FIGS. 5 and 6 show knitting with a fibre material 4 according to FIG. 2, the embodiment according to FIG. 7 is based on a device for processing a yarn material 21 which is designated as unconventional yarn. There is understood by the person skilled in the art with respect to an unconventional yarn a yarn which has twists which deviate from classic twists as are produced by ring or selfactor spinning. One advantage of such a yarn material 21 resides in particular in the fact that, in comparison to the fibre material 4 according to FIG. 2, increased tensile strength can be given to it. The yarn material 21 is then suitable for the purpose of being transported over fairly large stretches as is generally desired in the case of large circular knitting machines (needle cylinder diameter e.g. 30" or more) or at least in the case of circular knitting machines, the needle cylinders of which have larger diameters than the micro-circular knitting machines described with reference to FIGS. 5 and 6. It is possible with the yarn material 21 to choose the spacing between the delivery rollers 12 of the drawing equipment 14 and the knitting point 16 to be greater than is indicated in FIGS. 5 and 6.

FIG. 7 shows a section through the knitting point 16 of a circular knitting machine for processing short staple fibres by means of spinning elements of the known type. Between the drawing equipment 12 and the knitting point 16 there is situated a spinning element 22 which is intended for spinning an unconventional yarn 21 and from which the yarn 21 is directed in a pipe 23 to a yarn guide 24 which is formed here by the discharge end of the pipe 23. In turn the suction element 18 according to FIGS. 5 and 6 is situated opposite the opening of the pipe 23 or the yarn guide 24.

The fibre web 4 coming out of the drawing equipment 12 is spun here into an unconventional yarn 21 which can be for example a bundle yarn or wound yarn. The spinning process is adjusted such that in fact a sufficiently strong yarn is produced. The achievement of maximum strength is however not sought. The achieved strength requires to be only so great that the yarn material 21 can be transported over stretches of e.g. 50 to 100 cm through the pipe 23 to a knitting point 16, as is desired in the case of the mentioned larger circular knitting machines.

A sufficiently soft knitted yarn is produced. The production is cheaper because, in comparison to the classic procedure, a time-reduction occurs in this knitting process since the spooling is dispensed with.

The embodiment according to FIG. 8 relates to a device by means of which firstly a "temporary" yarn 25 is produced. This yarn 25 is described as "temporary" for the reason that typical classic twists are produced in the yarn which are completely removed according to the invention before immediately reaching the loop-forming point.

FIG. 8 shows a section through the knitting point 16 of a knitting machine analogously to FIG. 7 but with a twisting element 26 for producing the temporary yarn 25. Between the drawing equipment 14 and the knitting point 16 there is in the embodiment a twisting element 26, in the interior of which air turbulence 28 is produced by compressed air 27, said air turbulence suctioning the fibre web exiting from the drawing equipment 14 and spinning it into the temporary yarn 25.

The temporary yarn 25 is typically twisted and of classic character. It passes into a spinning pipe 29 in which it rotates at high speed. The spinning pipe 29 discharges in a yarn guide 30 which can be formed also by the end of the spinning pipe 29 which is orientated towards the circular knitting machine.

On the stretch between the yarn guide 30 and a schematically indicated loop-forming point 31, the typical twists of the temporary yarn 25 are removed virtually to zero so that the yarn material 32 processed in fact into knitted fabric does not comprise a yarn. The yarn material 32, as in FIG. 2, has rather practically no twists so that the mode of operation provided in FIG. 8 corresponds to the known false twist principle.

Again the suction element 18 is situated opposite the spinning pipe 29.

A device of this type, analogously to FIGS. 5 and 6, provides an extremely soft knitted fabric which is in addition cheap because the classic spinning process is circumvented and no spooling is provided.

Advantages of the false twist principle applied in FIG. 8 reside in addition in the fact that the yarn 25 transported in the spinning pipe 29 fulfils all strength requirements and can be transported over long stretches, whilst the finished knitted fabric has all the advantages which the fibre web 5 described with reference to FIG. 2 provides. The reversed rotation of the temporary yarn 25 to zero or virtually zero thereby occurs automatically on the way to the yarn guide 32 at the loop-forming point 31 so that preferably no particular measures are provided for the reversed rotation. Tests have shown that it suffices for this if the yarn guide 30 is disposed e.g. 5 to 7 mm in front of the loop-forming point 31 and hence the free yarn path or the spacing between the yarn guide 30 and the loop-forming point 31 is smaller than the staple fibre length present in the individual case in the fibre web 5.

FIG. 9 shows a section through the knitting point 16 of a knitting machine in an embodiment with a plurality of twisting elements 26*a*, 26*b* and 26*c* which are disposed in succession and configured essentially identically. The application thereof is then provided preferably when the delivery rollers 12 of the drawing equipment 14 are removed far away from the knitting point 16 as a result of the overall geometry. Between two successive twisting elements 26*a* and 26*b* or 26*b* and 26*c* respectively, the compressed air flow 27*a*, 27*b* or 27*c* required to produce turbulence is discharged outwardly preferably via ventilation openings 33, e.g. a gap on the relevant pipe 29.

It is according to the invention if the twisting elements 26*b* and 26*c* which follow after the first twisting element 26*a* are configured as rotating, mechanically operating rotating tubes which rotate at high speed. Successive twisting elements 26*b*, 26*c* including spinning pipes 29 can, corresponding to FIG. 9, stand at an angle relative to each other.

The twisting elements 26*a* to 26*c* are all supplied for example with compressed air and produce the turbulence 28 (FIG. 8). It is then sensible from an energy point of view to stagger the compressed air flows 27, 27*b* and 27*c* which are required to drive the turbulence 28. The compressed air flow 27*a* is then less strong (e.g. 0.2 bar) than the compressed air flows 27*b* and 27*c* (e.g. 3 to 4 bar). The central twisting element 26*b* can thereby be supplied with a maximum air pressure, whilst the twisting element 26*c* situated in the direct vicinity of the knitting point 16 is operated with an average air pressure. If a device of this type is set in motion, firstly all the twisting elements 26*a*, 26*b* and 26*c* are supplied with a compressed air flow 27*a*, 27*b* and 27*c*. If a stationary operating state is achieved, the compressed air flows 27*a*, 27*b* can be reduced or entirely set to zero. The compressed air flow 27*c* remains in every case completely switched on.

In FIG. 10, finally a section through the knitting point 16 of a knitting machine is represented in an embodiment with a yarn guide pipe 34 for an auxiliary yarn 8 according to FIG. 3. As a result, a fibre material 7 is supplied according to the invention to the knitting point 16 and contains according to FIG. 3, in addition to the fibre web 5, also the auxiliary yarn 8. The auxiliary yarn 8 can be supplied to the knitting point 16 via a further yarn guide situated next to the yarn guide 30 or at a position between the delivery rollers 12 and the twisting element 26. There is a preferred embodiment if the auxiliary yarn 8 is supplied via the yarn guide pipe 34 directly in front of the delivery rollers 12 of the drawing equipment 14, as FIG. 10 shows. This embodiment is advantageous because as a result the entire spinning and knitting process is more secure against yarn breakage.

FIG. 11 shows the plan of a circular knitting machine 35 with the needle cylinder 11. The drawing equipment 14 is disposed distributed in three groups 14.1, 14.2 and 14.3 around the cylinder 11 of the circular knitting machine 35. Each group 14.1 to 14.3 has a drive 37.1 to 37.3 which is synchronised expediently with the drive of the needle cylinder 11, not shown. A corresponding number of cans 38 is assigned to each group 14.1 to 14.3 of drawing equipment 14, said cans containing the fibre material in the form of a roving or the like. If the operation takes place with the auxiliary yarn 8 (FIG. 10), then a corresponding number of supply spools for the auxiliary yarn 8 is assigned to each individual piece of drawing equipment of one group 14.1 to 14.3. Each piece of drawing equipment 14 of a group of drawing equipment 14.1 to 14.3 is assigned in addition respectively to one system or one knitting point 16 of the circular knitting machine 35.

Between such circumferential regions of the needle cylinder 11, which are provided with knitting points 16 (FIG. 5), greater dead zones 39 can be disposed in which the circular knitting machine 35 has no knitting points 16 or at least none used during spin/knitting. This serves for the purpose of extending the circumferential portions provided with active knitting points 16 over a limited angle region $\alpha$ of e.g. 60° in order to avoid too great direction changes in the yarn course between the drawing equipment groups 14.1 to 14.3 and the associated knitting points. This is indicated in FIG. 11 by respectively two external lines 40*a*, 40*b* which designate the yarn paths situated respectively furthest outwards (e.g. spinning pipes 29 in FIG. 8). Between these two lines 40*a*, 40*b* there lie the yarn paths for the yarn materials 4 or 7 coming from the remaining drawing equipment of each group of drawing equipment 14.1 to 14.3.

This would mean in practice that, in the case of a large circular knitting machine, only approx. half of the knitting points 16 or knitting systems present in the normal manner is usable. However with respect to the price advantages which can be achieved with the yarn material 4 to 7 this is of subordinate importance. Alternatively, it would be possible to increase the diameter of the needle cylinder 11 in order to be able to accommodate a larger number of usable knitting systems at its circumference.

FIG. 12 shows a roughly schematic, vertical partial section through a device according to the invention according to FIG. 10 with a circular knitting machine 41 which is configured in the embodiment as a right/left circular knitting machine. The circular knitting machine 41 with the needle cylinder 11 stands on the workshop floor. There is a passage 42 present which serves to operate the needle cylinder 11. The passage 42 is limited by a group of cans 38 (FIG. 11) in which the rovings are situated which are guided to the drawing equipment 14 via transport mechanisms 43 configured for example as conveyor belts. The drawing equipment 14 is operated from an operating platform 44 which is situated above the passage 42 and is connected to supply spools 46 via the yarn guide pipes 34 and purveyors 45 which contain the auxiliary yarns 8. As a result of this arrangement, an arbour-like passage 47 is produced in which an operator can move.

A fibre web coming from drawing equipment 14 is guided to a knitting point 16 respectively according to the embodiment via pipes 23 (FIG. 7) or spinning pipes 29 (FIG. 8 to 10). Furthermore, the suction element 18 is present in which a separating device 48 is integrated, said device serving to set the knitting machine 41 in motion, as is explained further on.

The suction elements 18 of the knitting points 16 are preferably connected to a central suction mechanism 49. This picks up yarn residue or fibres which occur during start-up or during production as waste.

Since the knitting machine 41 preferably represents a large circular knitting machine which produces a knitted fabric with a very large circumference which can be even more significant if the dead zones 39 (FIG. 11) are present, the waste is preferably placed in a basement 50 in such a case in order that the machine remains operable.

Between the yarn guide pipes 34 and the supply spools 46 there are situated the purveyors 45. These enable a simple operation of a circular knitting machine of the described type.

Each purveyor 45, according to FIG. 13, has preferably a pressure roller 51 and a drive roller 52 which is coupled to a drive 53 via a free wheel 54. An auxiliary yarn 8 is guided in the gap between the pressure roller 51 and the drive roller 52.

The drive 53 is adjusted such that the delivery speed of a purveyor 45 is less than the delivery speed of the associated drawing equipment 14. It is achieved consequently that the purveyor 45, in the sense of a positive delivery device, controls the transport speed of the auxiliary yarn 8 in the yarn guide pipe 34 until the auxiliary yarn 8 has moved safely into the delivery rollers 12 of the associated drawing equipment 14. Thereafter and during knitting at high speeds, the transport speed of the auxiliary yarn 8 in the yarn guide pipe 34 is determined in contrast by the delivery rollers 12, in which case the free wheel 54 becomes effective and the auxiliary yarn 8 is withdrawn from the associated supply spool 46 by means of the delivery rollers 12.

The devices of the described type which can also be described as spin/knitting machines are set in motion for example as follows:

The needles 12 of the needle cylinder 11 are initially not extended and are all located in the concentric position. The auxiliary yarns 8 have been inserted into the purveyors 45. The spinning elements 22 or the twisting elements 26 and the drawing equipment 14 run at a speed which is synchronous to the needle cylinder rotation. However, rovings from the cans 38 are still not delivered by the transport mechanisms 43 which act as roving stops.

Firstly the purveyors 45 are now set in motion, the delivery speeds of which are smaller than the delivery speeds of the delivery rollers 12 of the associated drawing equipment 14. As a result, the auxiliary yarns 8 pass through the purveyors 45 and through the yarn guide pipes 34 into the drawing equipment 12 and via the spinning devices 22 or twisting elements 26 to the knitting points 16 where they are sucked in by the suction elements 18 and disposed radially relative to the needle circle of the needle cylinder 11. After all the knitting points 16 are provided with auxiliary yarn 8, the drawing equipment 14 and the purveyors 45 are stopped. The auxiliary yarns 8 which are situated and held in the suction elements 18 are now capped by means of the separating devices 48, i.e. cut off slightly behind the knitting needles 17, and the needle cylinder 11 and the drawing equipment 14 are at the same time set in motion synchronously with a pre-selected gear ratio so that the needles 17 are in fact extended but firstly pick up only the auxiliary yarn 8. The spin/knitting machine now knits in a conventional manner a so-called sack which is picked up by the take-down. If the knitting process has then proceeded so far that the take-down is operating properly, the drawing equipment 14 is supplied sequentially and/or in parallel with rovings by switching on the transport mechanisms 43. It is thereby understood by "sequential" that the drawing equipment 14 is not switched on simultaneously but in succession for example in the circumferential direction of the needle cylinder 11 in order, when starting up the circular knitting machine, to avoid irregularities and blockages by the fibres in the region of the needles 17.

A knitted fabric is produced with a softness to the touch not known to date.

The invention is not restricted to the described embodiments which can be modified in many ways. In particular, the described methods can be applied in an analogous adaptation also to flat knitting machines or to circular knitting machines with a stationary needle cylinder and a rotating cam. It is thereby clear that, instead of a circular knitting machine with only one knitting head (e.g. needle cylinder 11), also a circular knitting machine with a further knitting head (e.g. a dial) can be used. Furthermore, the dead zones 39 in FIG. 11 can be filled with further groups of drawing equipment 14 as long as the spatial conditions on a circular knitting machine permit this and no obstructive supports or the like disposed on the circumference of the needle cylinder are present. In this way, drawing equipment 14 with the associated and described elements could be assigned to each knitting system which is present. Finally it goes without saying that the various features can also be applied in combinations other than those described and represented.

The invention claimed is:

1. A method for producing a circular weft knitted tubular fabric on a circular weft knitting machine, comprising steps of:

drawing a continuous fiber band (5) in a drawing device (14) to obtain a drawn continuous fiber band (5);

twisting the drawn continuous fiber band (5) supplied from the drawing device (14) in a spinning device (22, 23; 26, 29) to continuously obtain a yarn material (4, 7) at an outlet end (24, 30) of the spinning device (22, 23; 26, 29);

feeding the yarn material (4, 7) obtained at the outlet end (24, 30) of the spinning device (22, 23; 26, 29) directly into a knitting point (16) of the circular weft knitting machine; and forming loops (1) with the yarn material (4, 7) at the knitting point for producing the circular weft knitted tubular fabric without unwinding the yarn material (4, 7)from a supply bobbin.

2. The method according to claim 1, wherein said fiber band (5) is spun in the spinning device (20, 23) into an unconventional yarn (21) and is processed in this state into loops.

3. The method according to claim 2, wherein a strength is given to the yarn (21) by means of the spinning process which strength suffices for its transport from the drawing device (14) to the knitting point (16).

4. The method according to claim 1, wherein the fiber band (5) is spun in the spinning device (26, 29) into a temporary yarn (25) having typical twists, is transported in this state to the knitting point (16) and is then, before it is processed into loops, changed back into an untwisted fiber web (32) by a false twist effect.

5. The method according to claim 4, wherein a yarn guide (30) is provided between the spinning device (26, 29) and the knitting point (16) and the temporary yarn (25) is left to itself between the yarn guide (30) and the knitting point (16).

6. The method according to claim 1, wherein the yarn material, before the beginning of a knitting process, is placed by suction transversely over a path to be described by needles (17) of the knitting machine and is retained in this position, and wherein the knitting process is then begun by moving the needles (17) along the path and raising them to receive the yarn material.

7. The method according to claim 6, wherein an end of the yarn material (4, 7) retained by suction is cut off at the latest after the beginning of raising the needles (17).

8. The method according to claim 1, wherein a yarn material (7) is used, the fiber web (5) of which is provided with an additional auxiliary yarn (8).

9. The method according to claim 8, wherein the knitting process is started in that firstly the auxiliary yarn (8) alone is processed into loops until the knitted fabric has a pre-selected length, and then the yarn material (7) comprising the fiber web (5) auxiliary yarn (8) is processed into loops.

10. An apparatus for producing a circular weft knitted tubular fabric, comprising:

a circular weft knitting machine comprising having knitting needles (17) and at least one knitting point (16) configured to form loops (1) from a continuous yarn material (4, 7);

drawing equipment (14) configured to draw an endless fiber band (5); and a spinning device (22, 23; 26, 29) configured to receive the fiber band from the drawing equipment (14), to twist the fiber band (5) for the formation of the continuous yarn material (4, 7) to the at least one knitting point (16) for directly knitting the circular weft knitted tubular fabric with the yarn material (4, 7) delivered from the spinning device (22, 23; 26, 29).

11. The apparatus according to claim 10, wherein a yarn guide (15, 24, 30) is disposed between the drawing equipment (14) and the knitting point (16).

12. The apparatus according to claim 10, wherein a suction element (18) is disposed on a backside of the needles (17).

13. The apparatus according to claim 10, wherein the spinning device is arranged to produce an unconventional yarn (21) and comprises a spinning element (22) and a spinning and transport pipe (29) connected thereto and ending at a yarn guide (24) or the knitting point (16).

14. The apparatus according to claim 10, wherein the spinning device is arranged to produce a temporary yarn (25) and comprises at least one twisting element (26) and a spinning and transport pipe (29) connected thereto and ending at a yarn guide (30) or the knitting point (16).

15. The apparatus according to claim 14, wherein the twisting element (26) is operable with air pressure.

16. The apparatus according to claim 14, wherein the spinning device comprises a plurality of spinning sections, each spinning section containing a twisting element (26*a*, 26*b*, 26*c*) and a spinning and transport pipe (29) connected thereto, wherein the last spinning and transport pipe (29) in a direction of the transport of the fiber band ends at the yarn guide (24, 30) or the knitting point (16).

17. The apparatus according to claim 16, wherein the twisting elements (26*a*, 26*b*, 26*c*) are operated with air pressure, a central twisting element (26*b*) being operated at a highest air pressure, a twisting element (26*a*) close to the drawing equipment (14) at a lowest air pressure, and a twisting element (26*c*) close to the yarn guide (30) at an average air pressure.

18. The apparatus according to claim 16, wherein the twisting element close to the drawing equipment (14) and the central twisting element (26*a*, 26*b*, 26*c*) can be stopped after spinning of the temporary yarn (25) has started.

19. The apparatus according to claim 13, wherein a ventilation opening (34) is assigned to at least one spinning and transport pipe (29).

20. The apparatus according to claim 10, further comprising a means for supplying an auxiliary yarn (8) to the yarn material (7).

21. The apparatus according to claim 20, wherein the means for supplying an auxiliary yarn comprises a supply pipe (34) which is disposed in front of delivery rollers (12) of the drawing equipment (14) and supplies the auxiliary yarn (8) to the spinning device.

22. The apparatus according to claim 10, wherein the knitting machine is a circular knitting machine, at the circumference of which a plurality of drawing equipment is disposed.

23. The apparatus according to claim 22, wherein the plurality of drawing equipment are combined into groups (14.1 to 14.3) and dead zones (39) free of active knitting points (16) are provided at the circumference of the circular knitting machine.

24. The apparatus according to claim 12, wherein a separating device (48) is assigned to the suction element (18).

25. The apparatus according to claim 10, wherein a can (38) filled with a roving is assigned to the drawing equipment (14) and a transport mechanism (43) for the roving is provided between the can (38) and the drawing equipment (14).

26. The apparatus according to claim 21, wherein a yarn feeding means (45) is disposed between the supply pipe (34) and a supply spool (46) for the auxiliary yarn (8).

27. The apparatus according to claim 26, wherein the yarn feeding means (45) has a pressure roller (51) and a drive roller (52) provided with a free wheel (54).

28. The apparatus according to claim 27, wherein the drive roller (52) is actuated at a lower circumferential speed than the delivery rollers (12).

* * * * *